United States Patent [19]

Rösch

[11] Patent Number: 5,065,915

[45] Date of Patent: Nov. 19, 1991

[54] HINGED MULTIPLE GARMENT HANGER

[76] Inventor: Wilhelm Rösch, Hinzbecker Höhe 30, D-4300 Essen 15, Fed. Rep. of Germany

[21] Appl. No.: 360,886

[22] PCT Filed: Jul. 7, 1988

[86] PCT No.: PCT/DE88/00420

§ 371 Date: Jun. 13, 1989

§ 102(e) Date: Jun. 13, 1989

[87] PCT Pub. No.: WO89/02714

PCT Pub. Date: Apr. 6, 1989

[30] Foreign Application Priority Data

Sep. 24, 1987 [DE] Fed. Rep. of Germany ... 8712870[U]

[51] Int. Cl.[5] ..... A47G 25/14; A47G 25/44; A47G 25/28

[52] U.S. Cl. ..... 223/89; 223/88; 223/95; 223/85; D6/315; D6/324; D6/327

[58] Field of Search ..... 223/85, 88, 95, 89, 223/92, 94; 211/113, 116, 118; 248/340, 303; D6/315, 324, 327

[56] References Cited

U.S. PATENT DOCUMENTS

| | | | |
|---|---|---|---|
| 3,224,596 | 12/1965 | Becker | 223/85 |
| 3,692,269 | 9/1972 | Hales | 223/85 |
| 4,709,838 | 12/1987 | Campbell | 223/85 |

FOREIGN PATENT DOCUMENTS

| | | | |
|---|---|---|---|
| 2913320 | 10/1979 | Fed. Rep. of Germany | 223/95 |
| 3213445 | 10/1983 | Fed. Rep. of Germany | 223/85 |
| 3335939 | 4/1985 | Fed. Rep. of Germany | 223/85 |
| 741528 | 12/1932 | France | 211/113 |
| 1075092 | 4/1954 | France | 211/113 |

*Primary Examiner*—W. C. Reynolds
*Assistant Examiner*—Bibhu Mohanty
*Attorney, Agent, or Firm*—Nils H. Ljungman & Associates

[57] ABSTRACT

A garment hanger for supporting several articles of clothing. The garment hanger has a plurality of U-shaped carrying bars that are telescopically, rotatably and slidably mounted in a carrying element. The garment hanger can be hung on a closet clothes bar so that a plurality of articles can be hung in a narrow space. The garment hanger is configured so that if one of the carrying bars is pulled out, the carrying bars that remain in position act as counter weights to balance the entire garment hanger system.

18 Claims, 5 Drawing Sheets

HINGED MULTIPLE GARMENT HANGER

FIELD OF THE INVENTION

The invention relates to a garment hanger for the simultaneous hanging and storing of several articles of clothing, with a carrying element provided with suspension hooks for hanging on a cloth bar or the like and with several carrying bars pivotable with respect to the carrying element, whereby the carrying bars are dimensioned to accommodate the garment to be held.

BACKGROUND INFORMATION

Such hangers are known which can simultaneously hold several garments, for instance trousers, whereby several carrying bars running mutually parallel in the same plane are assigned to the carrying element provided with a suspension hook. This kind of garment hanger has the disadvantage that it is really difficult for instance to slide the individual trousers onto the various carrying bars, or to remove them therefrom, without to get entangled each time with the garments which are already hanging there. Thereby, the individual bars are connected via a rod connecting the ends of all bars and running at a right angle with respect thereto , whereby the carrying element with the suspension is affixed thereto somehow as an extension.

The hanging of the garments can be simplified, when the carrying element itself is bow-shaped and connected with the rear connection rod through a hinged joint. The totality of the mostly five carrying bars can then be swung vertically for storing, or horizontally for the removal or hanging of the individual garments. This hinged or swivel joint is self-locking, in order to keep the carrying element in the vertical position while the trousers, for instance, are inserted. When the trousers are inserted, the assembly of carrying bars has only to be swung into the vertical position, so that they require very little space in the closet. However, even in this kind of garment hangers, the disadvantage of the difficulties in the insertion or removal of the garment in the case of several carrying bars persists, since there is very little space available for these operations. So, for instance, the trousers have literally to be inserted, which is made difficult due to the fact that these carrying bars are coated with an antislip plastic, in order to prevent the sliding of the trouser after they have already been inserted. Due to these problems, usually not all five, but only two or three of the carrying bars forming the assembly are mostly put to use. This way, the actual use is minimal, compared to the pursued aim. From the German open application 17 78 353.8 a garment hanger is known which is horizontally extendible, whereby the upper part of the hanger, for instance, is guided through corresponding eyes, which are fastened in the top of the closet. On the lower part of the hanger, trousers or a similar garment can be supported. It is disadvantageous that this arrangement requires a counterweight, in order to keep the hanger in a horizontal position, when it is either provided or not provided with a garment. From such a hanger it is not possible to make, without any further ado, a multiple coat hanger, which can then be simply hung on a cloth bar in a closet, or on any other object, such as the door of a closet.

OBJECT OF THE INVENTION

It is the object of the invention to create a multiple garment hanger, wherein the hanging and removal of the garment is facilitated and and is possible without removing the entire garment hanger from the place where it is suspended, whereby the garment hanger assembly has to remain hanging in its horizontal position.

SUMMARY OF THE INVENTION

The problem is solved in accordance with the invention due to the fact that two or more of the carrying bars are telescopically mounted in the carrying element, in such a manner as to insure a limited horizontal mobility and a capacity to rotate around their respective longitudinal axes.

With such a garment hanger it is possible each time to hang up or to remove two or more garments, preferably trousers, without hindering each other, whereby each time the respective carrying bar is pulled out, which is possible due to their telescopic construction. Thereby, the respective carrying bar with the hanging trousers, which remains in the storage position, acts advantageously as a counterweight for the carrying bars which are extended to their usable length, i.e. the carrying bars which have been extended from the storage position into the garment-receiving position. After the removal and hanging of another pair of trousers, or even without the trousers, the carrying bar is then brought back to its initial position, i.e. the storage position, so that again the compact package of more then two carrying bars is reestablished. A too long extension of the telescope, respectively of the telescopic carrying bars is prevented, since at the ends stops are provided, which simply and efficiently prevent a second extension. Since here every carrying bar is by itself swingably supported in the carrying element, the hanging as well as the removal of garments is facilitated, and in addition it becomes possible, by simply removing one of the suspension hooks to reach a very space-saving position. Generally speaking, the result is an optimally compact garment hanger, having two, five or more mutually parallel carrying bars, which when suspended, for instance from a cloth bar, can do without any counterweight for the extendible, respectively telescopically slidable carrying bars, since the carrying bars remaining in the storage position, with hanging garments, serve as the respective counterweight.

According to a suitable embodiment of the invention, the carrying bars are so built that, when extended, they would lock the remaining carrying bars in the storage position . This is meant to prevent that, when already one of the carrying bars with hanging garments is brought from the storage position into the garment-removal- or receiving position, other carrying bars would also start to slide. This way, the entire package is prevented from losing its balance, in a simple and safe manner, since due to the locking, the counterweight function is each time taken over by the bars remaining in the storage position.

A particularly suitable and advantageous embodiment of the invention proposes that the carrying bars be made of two mutually parallel bars, running at a distance from each other, and connected by a U-shaped portion, wherefrom one is slidably and pivotably guided in the carrying element which is arranged at a right angle with respect to the carrying bar, while the other one serves as the actual carrying bar. The carrying bar according to the invention forms this way a U with excessively long legs, whereby the one bar serves for the support of the garment, while the other is slidably and pivotably supported in the carrying element. This way, the U-shaped carrying bar can be adjusted in any desired position in order to receive a garment, or to be brought back to the rest position. Here also, the group of carrying bars are swung either in a horizontal plane or in a vertical plane, by bringing the entire carrying element in the corresponding position. It is even more advantageous when the carrying element has two such suspension hooks, whereby in the rest position, only one hook assumes an active position, while the second hook is necessary to bring the carrying element into the horizontal plane, in order to telescope, respectively to slide back and forth the individual U-shaped carrying bars in accordance with the above description.

A particularly good telescope effect is achieved when the carrying element is a solid rod and is equipped with several, preferably five equidistanced bores for the carrying bars. This way for the upper rod of the U-shaped carrying bars a secure guiding support in the carrying element is created, so that a tilting or an uneven load during extension or retraction, and thereby telescoping, can not occur Due to the given distance between the individual bores, a balanced load of the carrying elements is insured even when only some of the carrying bars slidably mounted thereon are weighted down by garments. It appears to be particularly advantageous to use five such carrying bars because this way an optimal load distribution on the carrying element can be achieved.

It has been previously explained that the carrying element has either a centrally located and mostly swingably mounted suspension hook, or two suspension hooks, whereby according to the invention the carrying element has suspension hooks suitably arranged at both ends with openings facing in the same direction and swingably supported in the carrying element. Due to this swingability, it becomes possible to bring the carrying element from the horizontal into the vertical position, when one of the hooks is unhooked. The arrangement of the suspension hooks at the extremities facilitates their handling, since this way the hooks are easily accessible and due to the same openings, respectively identically shaped hook openings, can be easily slipped over the cloth bar of the closet. Then, the carrying element is brought in the horizontal position and the thereon slidably arranged carrying bars can be shifted from one position into the other, for instance in order to remove or hang the respective garment.

In order to maintain the balance of the entire system, and this with the retracted telescope, as well as with the extended telescope, according to the invention, the suspension hooks are mounted in or on the carrying element, offset in the direction of the U-shaped portion of the carrying bars. This design makes possible to arrange the suspension hooks exactly there where they optimally keep the balance of the entire system, without any modifications of the actual garment hanger. It is also conceivable that the extensions on the carrying element destined to receive the suspension hooks be arranged slidably or telescopically, in order to balance each time the system's center of gravity.

The length of the upper bar establishes the telescopic path, whereby the stop member is located at the end side of the bar, namely the upper bar. In order to make possible a precise fixation also on the opposite side, respectively to precisely establish the sliding path, it is suitable to provide that the lower bar and the U-shaped portion be covered with a plastic layer, and the stop member be formed on the free end of the upper bar. This way, the limit of the plastic layer, respectively the thereby formed projection constitutes the second limit of the sliding path. A special arrangement, respectively configuration in this area is therefore not necessary.

The assembly, i.e. the insertion of each upper bar in the carrying element, respectively the therein provided bores, becomes possible without any further ado even with the arrangement of the stop member at the free end of the upper bar, when the stop member is an annular thickening of the upper bar and when a slot-shaped notch, extending over the stop member, is provided in the bar. The two end portions in the area of the slot-shaped notch can thereby be pressed together during the insertion, so that the bore can be traversed easily, and then, after the bore has been traversed, they can be extended again through spring action, thereby creating the effective stop member. The intended retraction of the upper bar through the bores is only then possible, when the two ends, respectively the two terminal portions, are pressed together in the area of the thickening. This way, an excessively long telescopic extension of the carrying bars of the garment hanger is safely prevented.

An optionally tight fitting under load of the individual carrying bars on the carrying element is made possible, according to the invention, by the fact that the carrying element has bow-shaped grooves between the individual bores, at least on one side and running parallel to the bores. When one of the suspension hooks is hung up and the carrying element is correspondingly pivoted, the individual carrying bars fit advantageously in these grooves, and give the entire system an advantageously uniform load distribution. Thereby, the fit of the carrying bars is optimal when the grooves are shaped correspondingly to the lower bars and arranged correspondingly to the distance between the upper and the lower bars.

A telescopic effect which can be doubled in a certain sense is achieved according to a further embodiment of the invention, due to the fact that the upper bar is extended over the U-shaped portion and the lower bar provided with a suitable recess, can be slidably mounted thereon. This way, the lower and the upper bar form together a genuine telescope, the lower bar being tubular for this purpose, while the upper bar is still suitably made of a solid material, Just as before. Naturally, it is conceivable to make the system work only with this genuine telescopic bar, but then the balance of the system is somehow harder to maintain, while particularly in the case of the "double telescopability" it is especially advantageous to reach the corresponding weight balance.

According to the invention, the suspension hooks can also favorably influence the weight balance, by being shaped like an arc of circle and having a hook opening located underneath the center of the circle. This way, a safe suspension is always insured, without unintended slippage of individual garments, when the load is uneven. Moreover, the individual suspension hook will oscillate on the cloth bar of the closet, so that the desired uniform position of the entire garment hanger will be insured.

The garment hanger according to the invention can also be used for hanging and storing of skirts, whereby towards the ends of the lower bar, on its underside at the respective end open hooks are formed. The slippage of the garments, respectively skirt loops off the hooks is prevented by providing towards the end of the bar, each time two or more successive hooks and an arresting projection after the first hook at the end of the bar. The skirts are subjected to a certain prestressing, achieved in a simple manner, by providing a recoil element, preferably a spring, between the extended upper bar and the lower bar, which is arranged so as to surround and push against the upper bar. This way, the lower bar is kept by the spring at its respective maximal length, and the advantageous prestressing is reached.

The suspension from doors and other objects is facilitated by the fact that at least two of the 0-shaped bends are extended upwardly and towards the side facing away from the bars to form a door hook, whereby this door hook has an angular shape. The horizontal portion of the door hook can be length-adjustable and prestressed by a spring, so that it is possible to easily adjust the garment hook to the thickness of the object which support it. The back-and-forth movement of the carrying bars by providing a handle surrounding the O-shaped bends, on the one hand, and the free end of the lower bar, on the other hand, and serving as a stop element at the same time.

The invention distinguishes itself particularly due to the fact that the design of the individual carrying bars considerably facilitates the use of such multiple garment hangers, namely due to the fact that each of these individual carrying bars can be displaced in such a way as to allow each other carrying bar to optimally receive the selected garment. The other carrying bars remaining in the storage position create thereby the counterweight which takes care that the entire package of the garment hanger is each time maintained in the optimal horizontal position. Only after the respective garment has been hung over or from the bar, the loaded carrying bar is set back in its rest position, respectively storage position, and forms then with the rest of the bars a common hanging plane, so that the hung garments together with the garment hanger occupy very little space in the closet. The novel garment hanger can be used for the hanging of two or five pair of trousers, as well as for the hanging of the same number of skirts, whereby the hanging of the skirts is simply achieved through correspondingly arranged bent hooks, formed on the lower bar. In addition to easy handling, it is advantageous that the individual garments can be stored very close to each other, due to the clever arrangement, so that a space-saving arrangement is possible, whereby an easy and safe handling is always a prerequisite.

BRIEF DESCRIPTION OF THE DRAWINGS

Further details and advantages of the object of the invention result from the following description of the pertaining drawing, wherein a preferred embodiment, with the required details and components, is illustrated. The drawing shows.

DESCRIPTION OF THE PREFERRED EMBODIMENTS

Figure 1:
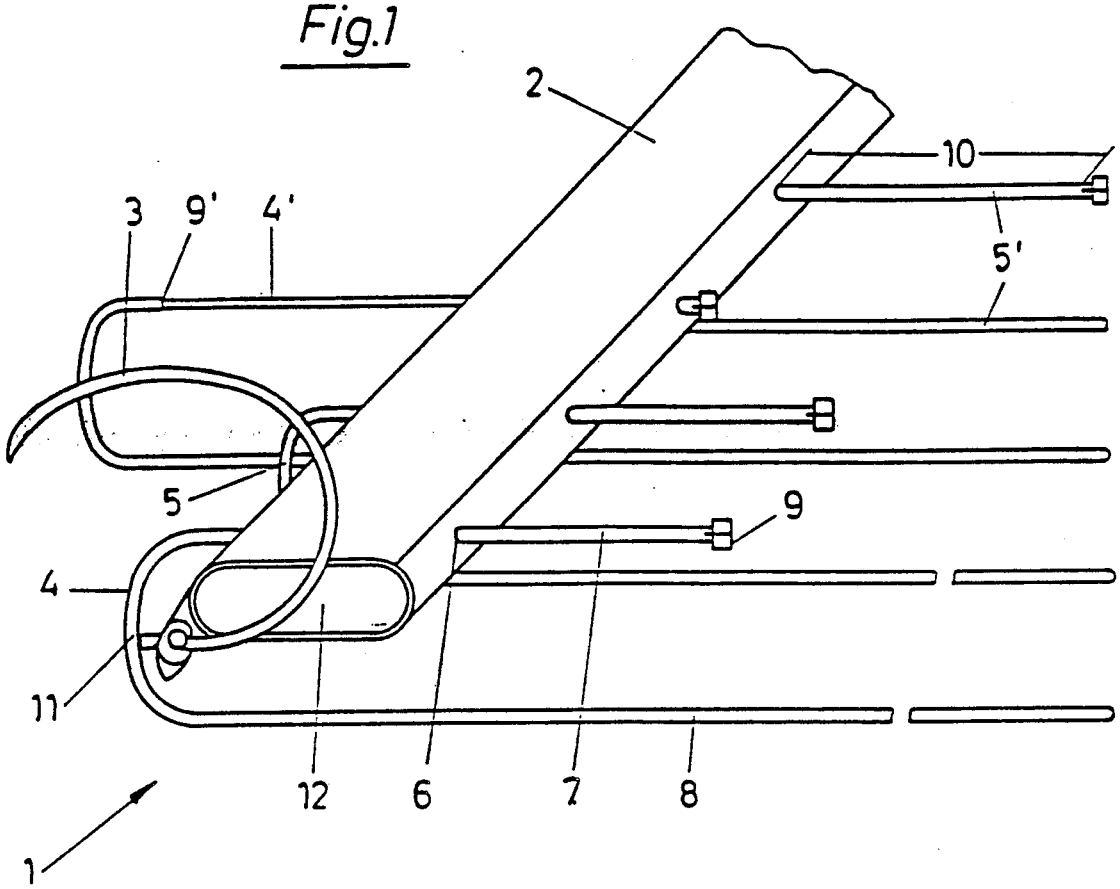
FIG. 1 a garment hanger built as multiple garment hanger in a perspective view.

FIG. 1 shows a garment hanger (1) in a perspective view, wherein the carrying element (2), built as a rectangular rod, runs centrally. This carrying element (2) has suspension hooks (3) at both ends, only one of them being shown here. Several carrying bars (4, 5) are slidably mounted in the carrying element (2), whereby the carrying bars (4, 5, 5') are shown in a position wherein they favorably receive the garments, while the carrying bar (4) is in a rest position, i.e. after a corresponding garment, preferably a pair of trousers, has been hung thereon.

The carrying bars (4, 5, 4', 5') are slidably and pivotably mounted in bores (6), so that the carrying bars (4, 5), consisting of a first an upper bar (7) and a lower carrying bar (8), can each be brought together with the carrying element (2) into a rest- or active position.

The hanging, respectively removal, of the garments is considerably facilitated by these carrying bars (4, 5) acting as telescopes, whereby the individual carrying bars (4, 5) are prevented from completely sliding out or from sliding too far by stop elements (9) located towards the end of the upper bar (7). By this stop element (9) and the stop element (9') on the opposite side, the telescopic travel path (10) is effectively limited, so that the optimal position of the hanger is preserved, independently from the position of each individual carrying bar (4, 5) at any given moment.

The two bars (7, 8) together with connecting U-shaped portion (11) form a stable assembly, which as such can be moved back and forth over the upper rod (7) through the rod (12) made of solid material, representing the carrying element (2). Due to a corresponding width of the rod made of solid material, a secure support of the carrying bars (4, 5) is insured, independently from their respective position.

Figure 2:
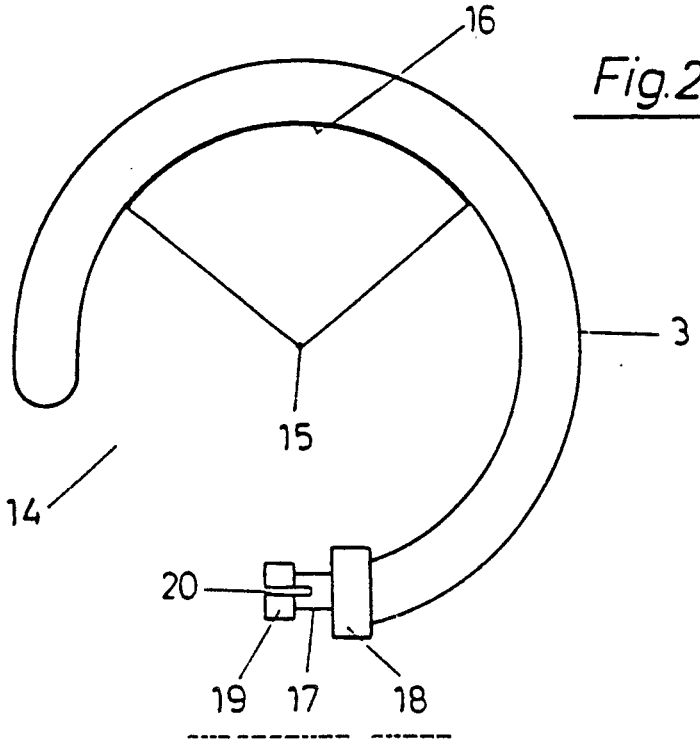
FIG. 2 a side view of a suspension hook.

FIG. 2 shows a correspondingly enlarged suspension hook (3) in order to show clearly that these suspension hooks (3) also take over a particular function. As shown in FIG. 2, these suspension hooks (3) are circularly designed, whereby one circle segment is cut out for the hook opening. This hook opening (14) is located below the center (15) of the circle, in order to prevent the garment hanger (1) to inadvertently slide or fall off the cloth bar gripped by the hook (3). On the inner edge of the suspension hook (3) a load area (16) is marked as such, whereby this area has to be suitably smooth, in order to make possible that the suspension hook (3) can optimally balance out the load of the garment hanger in its position.

For the connection with the carrying element (2) or with a corresponding extension which will be described later, at one hook opening (14) a tilt rim (17) is provided, which is limited by the slide-in stop element (18) and the stop rim (19). The stop rim (19) which is actually a thickening with respect to the tilt rim (17), is provided with a longer notch (20), in order to create here a kind of spring effect, which facilitates the insertion and the subsequent fastening in the carrying element (2). It is advantageous that this notch (20), respectively the design of the entire arresting means, creates the possibility to pivotably mount the suspension hook (3) on the carrying element (2), in an effective and simple manner.

While FIG. 1 shows the position wherein the garment hanger (1) can be loaded with garments or wherein the individual garments can be removed. FIG. 2 shows the rest position, wherein the entire garment hanger (1) is suspended only by the one suspension hook (3) mounted towards the end. The lower hook (22) however is not in use. It is used only when the garment hanger (1) is to be brought in the position shown in FIG. 1.

The individual suspension hooks (3, 22) are mounted on laterally offset extensions (23), which, for this purpose, are provided with a bore (24), wherein the suspension hooks (3, 22) and their tilt rim (17) can engage. For the sake of simplicity, here only two of the total of five carrying bars (4, 5) are shown completely, while the others are only indicated. Thereby it becomes clear that each lower bar (8) in the position seen in FIG. 3 slides into a groove (26, resp. 27) formed there together with its plastic coating (25), so that an almost vertical position of the carrying element (2) can be reached, and this way an optimally reduced space is required. The individual carrying bars (4, 5) are in an intermediate position, i.e. not completely in the rest position, wherefore they can be slightly pushed to the left. Not represented here are the extensions on the free ends of the upper bar (7). The extension (23) form here a prolongation of the lateral edges of the carrying element (2) , whereby the extensions (23, 23') can be even farther laterally offset, in order to provide an equilibrium of the entire system.

Figure 3:
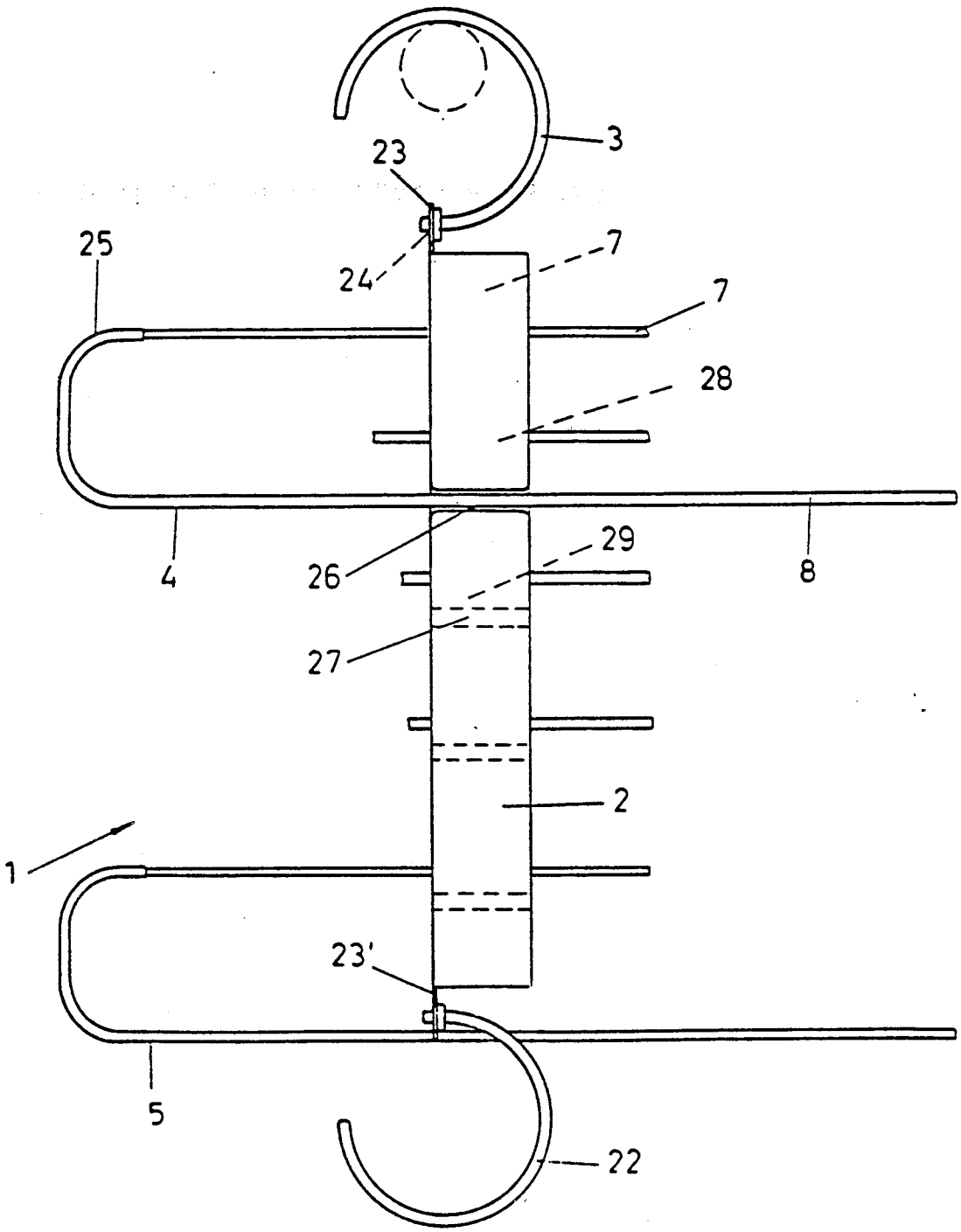
FIG. 3 The garment hanger according to FIG. 1, in rest position, with only one activated suspension hook, FIG. 4 a frontal view of the carrying element, FIG. 5 a side view of the carrying element, FIG. 6 a side view of a carrying bar, FIG. 7 a carrying bar with telescopically mounted lower bar, FIG. 8 a side view of a carrying bar with hooks formed thereon, for the hanging of skirts, FIG. 9 a door hook formed on the rear end of a carrying bar.
Figure 4:
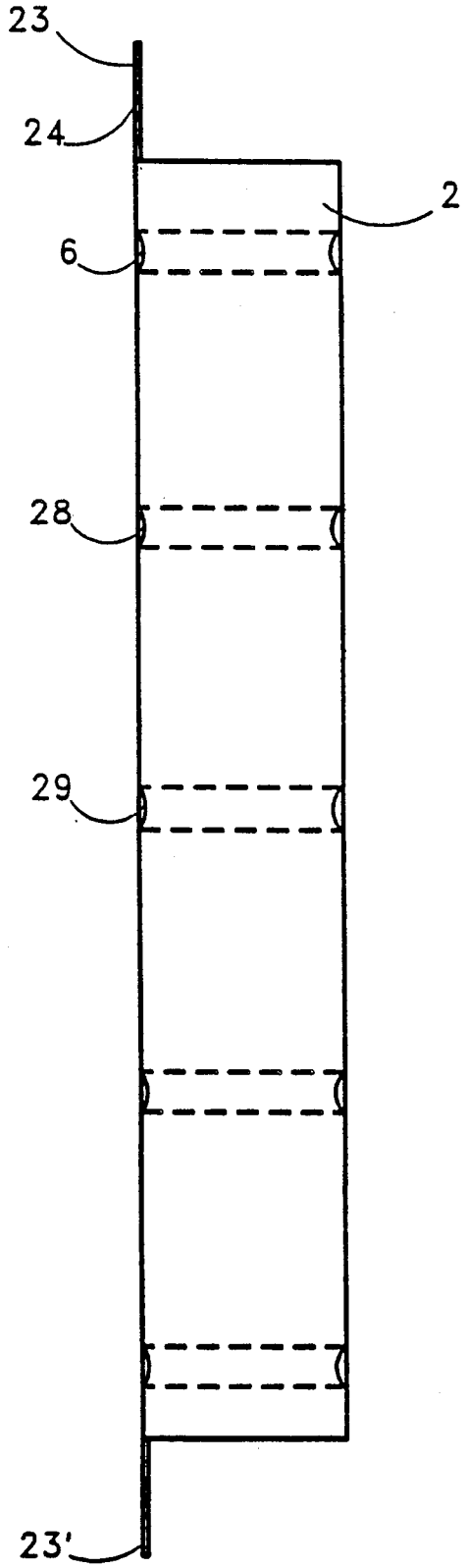
Figure 5:
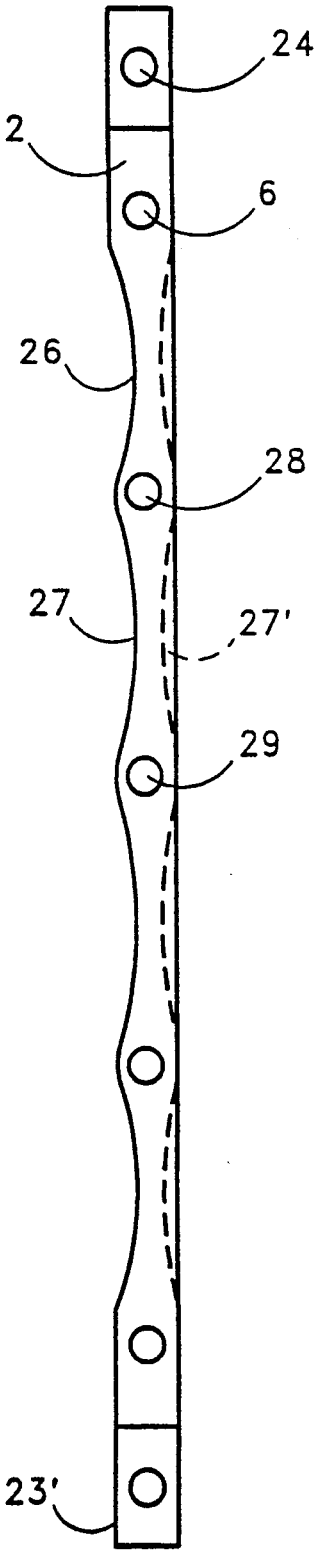

The individual grooves (26, 27) each run parallely to the bores (28, 29, 6), as shown in FIG. 4 and FIG. 5, where the carrying element (2) is represented in a frontal view and in a side view. While the groove (26, 27) according to FIG. 3 is actually a kind of notch, FIG. 5 shows an embodiment, wherein the grooves are correspondingly bow-shaped recesses between the individual bores (6, 28, 29).

Figure 6:
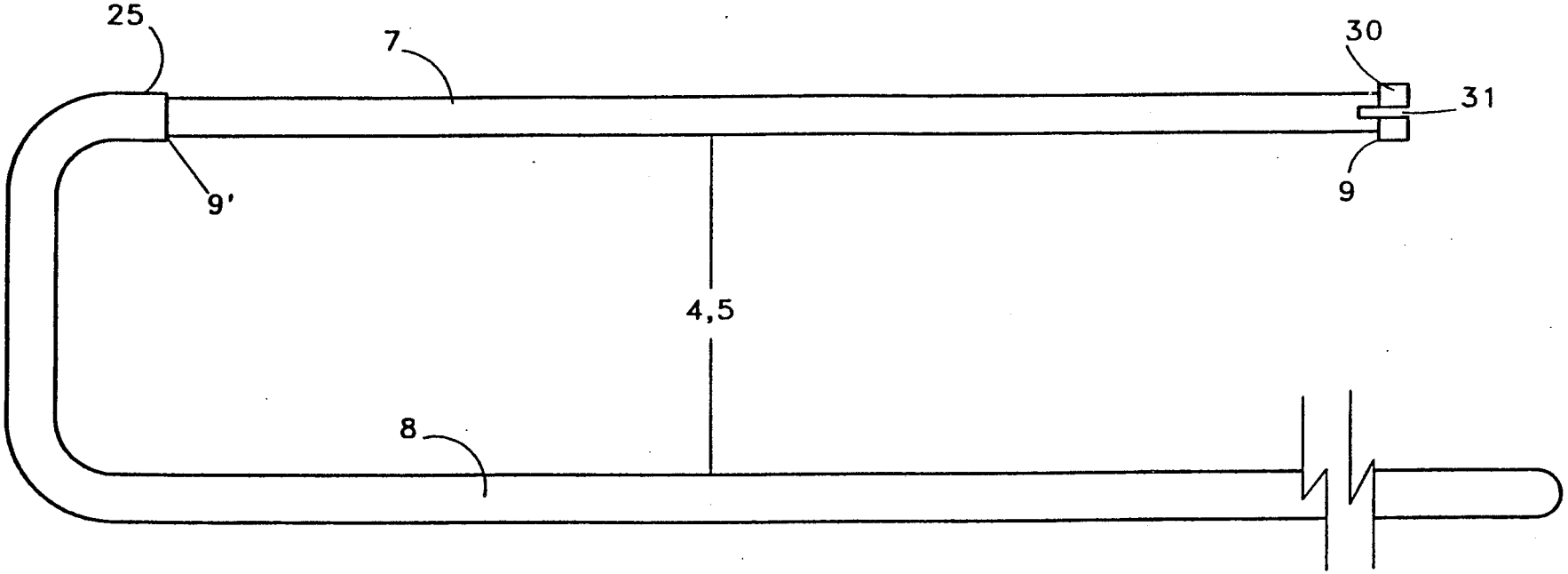

FIG. 6 shows one of the carrying bars (4) in a lateral view, whereby it is once more clearly shown that only the U-shaped portion (11) and the lower bar (8) are suitably provided with a plastic coating (25). As a result, in the end area of the upper bar (7) the desired additional stop member (9') is formed, while the necessary stop member (9) is formed at the free end. It is achieved by a thickening (30), wherein a notch (31) is provided, in order to make possible a compression and the insertion into the bores (6, 28, 29) of the carrying element (2). After the insertion and traversing of the bores, the two parts are separated by spring force, so that the desired stop member (9) is created.

For the case that the carrying bar (4, resp. 5) is made in its entirety of a certain plastic material, the desired stop member (9') can be formed by a corresponding thickening, whereby, in order to increase the loading capacity, the U-shaped portion (11) and the lower bar (8) can have a larger diameter than the upper bar (7).

Figure 7:
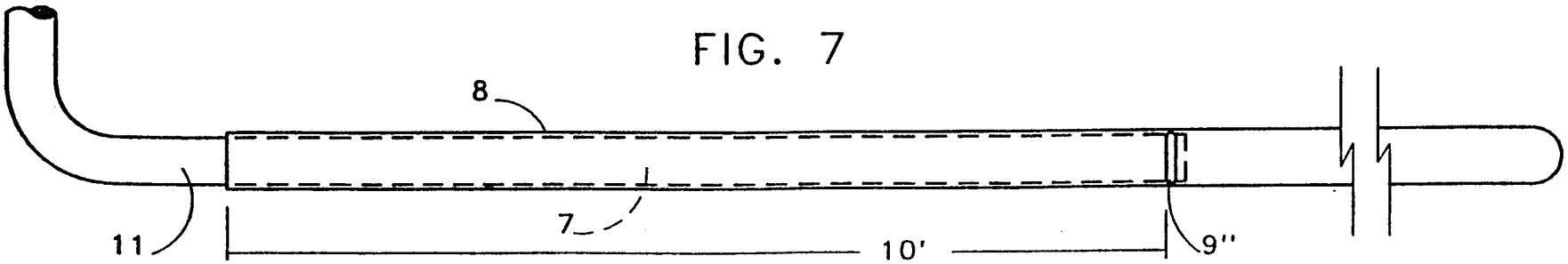

FIG. 7 shows a further suitable embodiment, whereby here the lower bar (8) is additionally or only by itself telescopically constructed. Therefore, the upper bar (7) is extended over the U-shaped portion (11), so that the lower bar (8), provided with a corresponding recess (32) can slide on top of it. Here also a stop member (9'') is provided, which effectively limits the telescopic travel path (10).

In the embodiment shown in FIG. 7, depending on the kind of load, it is possible to either bring the entire carrying bar (4) in the loading position by correspondingly adjusting the upper bar (7) in the carrying element (2), or, as it can be sufficient under certain circumstances, to make use of the telescopic travel path (10) according to FIG. 7. Further, it is also possible to use both telescopic travel paths, or telescopic travel-path segments (10, 10'), in order to create a widely extensible embodiment, facilitating the hanging of individual garments. Then, the lower bar (8) is pushed back, and subsequently so is the entire carrying bar (4).

Figure 8:
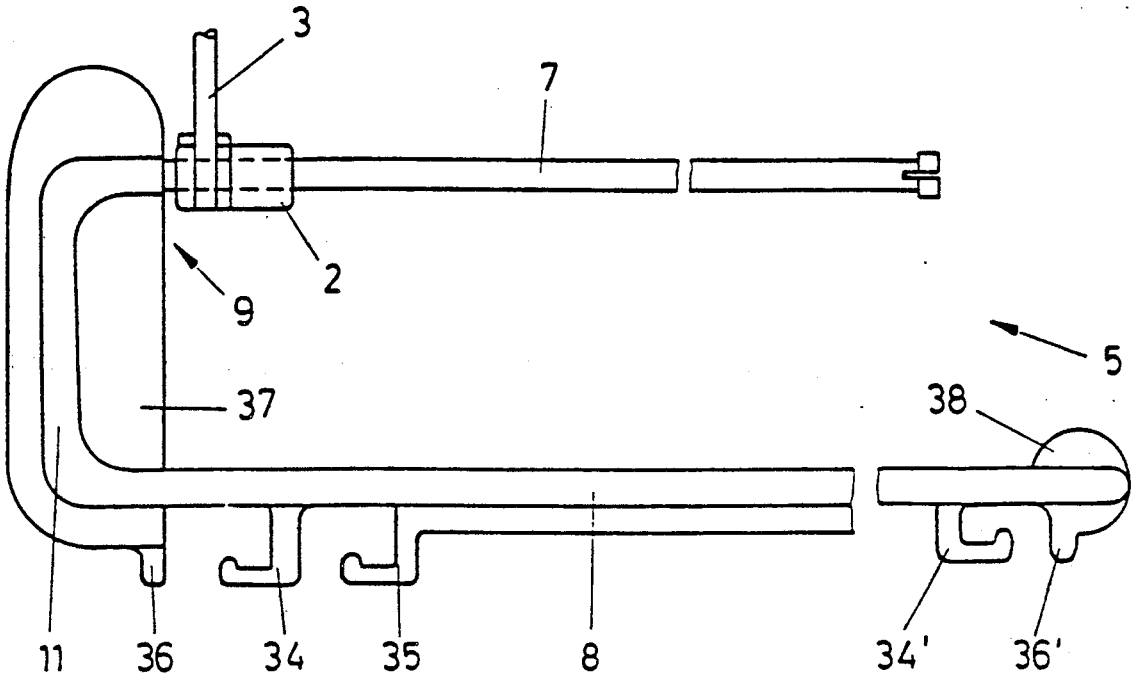

The embodiment illustrated in FIG. 8 is remarkable primarily due to its higher stability, which is characterized by the particular configuration of the U-shaped portion and, as well as of the lower carrying bar. In order to also make possible the simple hanging and arranging of skirts on the garment hanger, on each of the lower bars (8), hooks (34, 35, 34') are formed. The hook groups (34, 35, 34') are open towards opposite sides, namely respectively towards the ends of the lower bar (8), whereby the opening of the respective first hook (34, 34') is limited by an arresting dog (36), so that, once hung up, the garments can not slip off the hook so easily.

Essentially, the special configuration of the U-shaped portion (11) does not serve to increase the stability of the entire system, but rather as a handle (37) for the extension and retraction of the bars (7, 8). Correspondingly, also the free end of the carrying bar (8) is equipped with a similarly shaped handle (38). Both handles (37, 38) serve at the same time as stop member (9) and are equipped with an arresting dog (36) which has already previously been described.

Figure 9:
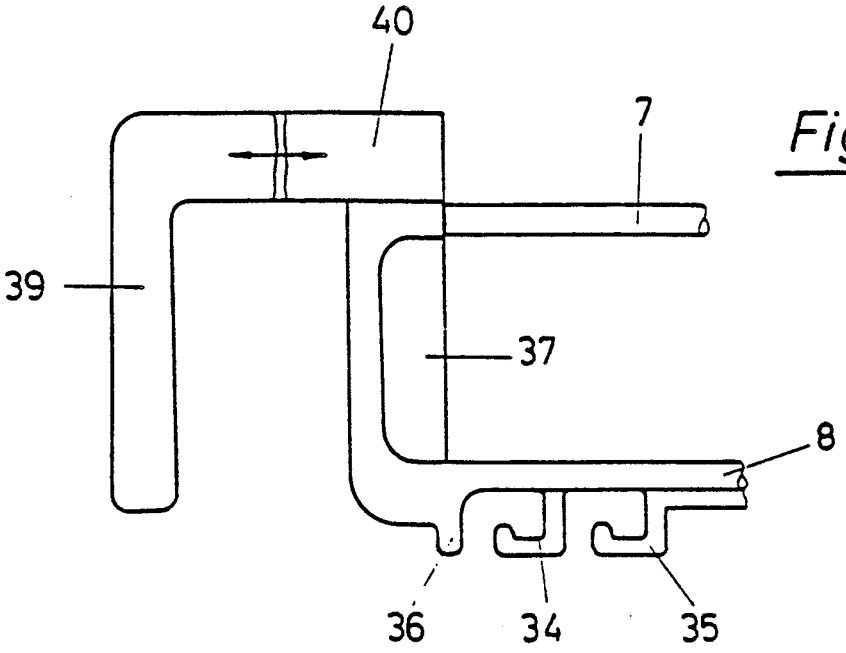

FIG. 9 shows insofar a complementary embodiment, as here the U-shaped portion (11) is prolonged and squared to create a door hook, namely in this case an angular door hook (39). In the embodiment seen in FIG. 9, the horizontal web (40) is extensible, so that an optimal adjustment to the object on which the garment hanger (1) is supposed to hang, is possible. Thereby it is sufficient that, for instance, from five such carrying bars (4, 5) two have corresponding door hooks (39).

What is claimed is:

1. A garment hanger for the simultaneous hanging and storage of a plurality of articles of clothing, said garment hanger comprising:

a carrying element provided with at least two suspension hooks, said carrying element defining a first longitudinal axis;

first bar means;

means for connecting said first bar means pivotably and slidably to said carrying element;

said first bar means defining a second longitudinal axis;

said first longitudinal axis being generally transverse to said second longitudinal axis; and said first bar means being pivotable about said second longitudinal axis.

2. The garment hanger according to claim 1, wherein:

a second bar means is connected to said carrying element, said second bar means being configured to assume a storage position and an extended position;

said first bar means is configured to assume a storage position and an extended position; and said first bar means is configured such that when said first bar means is in said storage position, said first bar means stabilizes said second bar means when said second bar means is in said extended position.

3. The garment hanger according to claim 1, further including:

carrying bar means;

means for connecting said first bar means to said carrying bar means;

said means for connecting said first bar means to said carrying bar means being generally U-shaped;

said first bar means being positioned a first distance from said carrying bar means;

said first bar means being generally parallel to said carrying bar means; and said carrying bar means being configured to receive the article of clothing.

4. The garment hanger according to claim 3, wherein:

said carrying element comprises rod means constructed of solid material; and said carrying element further comprises a plurality of bores for receipt of said first bar means.

5. The garment hanger according to claim 3, wherein:

said suspension hooks are pivotably connected to said carrying element; and said suspension hooks each define an open and curved contour.

6. The garment hanger according to claim 3, wherein:

said carrying element has a first longitudinal edge and a second longitudinal edge substantially parallel to said first longitudinal edge; and said suspension hooks are positioned adjacent said first longitudinal edge.

7. The garment hanger according to claim 3, wherein:

at least a portion of said carrying bar means is covered with plastic; and said first bar means further includes stop means for limiting an amount of sliding of said first bar means relative to said carrying element.

8. The garment hanger according to claim 7, wherein:

said stop means comprises an annular thickening of said first bar means; and said stop means and said first bar means have a notch for facilitating the connection of said first bar means to said carrying element.

9. The garment hanger according to claim 3, wherein said carrying element defines groove means for receiving a portion of said carrying bar means, said groove means being spaced said first distance from said first bar means.

10. The garment hanger according to claim 3, wherein said carrying bar means is slidably connected to said means for connecting said first bar means to said carrying bar means.

11. The garment hanger according to claim 1, wherein said suspension hooks define a circularly configured portion.

12. The garment hanger according to claim 3, wherein said carrying bar means comprises a plurality of garment hook means.

13. The garment hanger according to claim 12, wherein said carrying bar means comprises an arresting stop means, said arresting stop means being positioned adjacent to at least one of said garment hook means.

14. The garment hanger according to claim 3, wherein said means for connecting said first bar means to said carrying bar means comprise a door hook means.

15. The garment hanger according to claim 14, wherein:

said door hook means comprises a first piece and a second piece;

said first piece being substantially aligned with said second longitudinal axis; and said second piece is generally transverse to said first piece.

16. The garment hanger according to claim 1, wherein said first piece comprises a length-adjustable means.

17. The garment hanger according to claim 11, further including biasing means positioned between said carrying bar means and said means for connecting said first bar means to said carrying bar means.

18. The garment hanger according to claim 3, wherein:

said means for connecting said first bar means to said carrying bar means comprises a first handle means;

said first handle means envelope at least a portion of said means for connecting said first bar means to said carrying bar means;

said carrying bar means comprises a second handle means;

said second handle means envelope at least a portion of said carrying bar means; and said second handle means is an arresting stop means.

* * * * *

UNITED STATES PATENT AND TRADEMARK OFFICE

CERTIFICATE OF CORRECTION

PATENT NO. : 5,065,915

DATED : November 19, 1991

INVENTOR(S) : Wilhelm RÖSCH

It is certified that error appears in the above-identified patent and that said Letters Patent is hereby corrected as shown below:

In column 2, line 1, after 'garment', delete "is" and insert --are--.

In column 2, line 1, after the second occurrence of 'and', delete "is" and insert --are--.

In column 3, line 23, after 'occur', insert --.--.

In column 4, line 26, after 'An', delete "optionally" and insert --optimally--.

In column 4, line 48, after 'material,' delete "Just" and insert --just--.

In column 6, line 21, after 'first', insert --or--.

In column 6, line 59, after 'one', insert --end of the--.

In column 7, line 5, after 'be', delete "removed." and insert --removed,--.

In column 7, line 28, after 'The', delete "extension" and insert --extensions--.

UNITED STATES PATENT AND TRADEMARK OFFICE

CERTIFICATE OF CORRECTION

PATENT NO. : 5,065,915

DATED : November 19, 1991

INVENTOR(S) : Wilhelm RÖSCH

It is certified that error appears in the above-identified patent and that said Letters Patent is hereby corrected as shown below:

Col. 10, Claim 16, line 1, after 'claim', delete "1," and insert --15,--.

Col. 10, Claim 18, line 5, after 'means', delete "envelope" and insert --envelops--.

Col. 10, Claim 18, line 10, after 'means', delete "envelope" and insert --envelops--.

Signed and Sealed this

Twenty-fourth Day of August, 1993

*Attest:*

*Attesting Officer*

BRUCE LEHMAN

*Commissioner of Patents and Trademarks*